US009238361B2

(12) United States Patent
Muraoka et al.

(10) Patent No.: US 9,238,361 B2
(45) Date of Patent: Jan. 19, 2016

(54) LIQUID EJECTING HEAD AND LIQUID EJECTION PRINTING APPARATUS

(71) Applicant: CANON KABUSHIKI KAISHA, Tokyo (JP)

(72) Inventors: Chiaki Muraoka, Kawaguchi (JP); Yukuo Yamaguchi, Tokyo (JP); Satoshi Oikawa, Yokohama (JP); Junji Tatsumi, Kawasaki (JP); Satoshi Kimura, Kawasaki (JP); Takuya Iwano, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/866,522

(22) Filed: Apr. 19, 2013

(65) Prior Publication Data

US 2013/0286099 A1 Oct. 31, 2013

(30) Foreign Application Priority Data

Apr. 27, 2012 (JP) ..... 2012-103792

(51) Int. Cl.

| | |
|---|---|
| ***B41J 2/165*** | (2006.01) |
| ***B41J 2/01*** | (2006.01) |
| ***C25D 7/00*** | (2006.01) |
| ***B41J 2/175*** | (2006.01) |

(52) U.S. Cl.

CPC *B41J 2/01* (2013.01); *B41J 2/1753* (2013.01); *C25D 7/00* (2013.01)

(58) Field of Classification Search

None

See application file for complete search history.

(56) References Cited

U.S. PATENT DOCUMENTS

| | | | | |
|---|---|---|---|---|
| 6,435,663 | B2 | 8/2002 | Yamaguchi et al. | |
| 6,749,287 | B2 * | 6/2004 | Osada et al. | 347/50 |
| 6,808,252 | B2 | 10/2004 | Ohashi et al. | |
| 6,824,243 | B2 | 11/2004 | Yamaguchi et al. | |
| 6,957,883 | B2 | 10/2005 | Yamaguchi et al. | |
| 8,052,251 | B2 | 11/2011 | Kudo et al. | |
| 8,100,505 | B2 | 1/2012 | Kuroda et al. | |
| 2011/0134191 | A1 * | 6/2011 | Kajiura | 347/58 |

FOREIGN PATENT DOCUMENTS

JP 2002-79655 A 3/2002

* cited by examiner

*Primary Examiner* — Alejandro Valencia

(74) *Attorney, Agent, or Firm* — Fitzpatrick, Cella, Harper & Scinto

(57) ABSTRACT

The liquid ejecting head includes a printing element board having a plurality of printing elements for producing energy used to eject liquid, a contact board having a contact terminal for electrically connecting to a liquid ejection printing apparatus, and a functional element, and a plurality of lands which are provided on a face of the contact board where the functional element is mounted, and to which terminals of the functional element are connected. In addition, a wiring member connects the printing element board to the contact board, a first terminal is configured to be electrically connected to the printing element board, and a second terminal is configured to not be electrically connected to the printing element board, with both terminals disposed on one edge of the contact board. A first wiring connects the contact terminal to the first terminal, a second wiring connects at least one of the plurality of lands to the second terminal, and insulating resin covers an edge face of the second terminal positioned on the one edge of the contact board.

11 Claims, 7 Drawing Sheets

LIQUID EJECTING HEAD AND LIQUID EJECTION PRINTING APPARATUS

BACKGROUND OF THE INVENTION

1. Field of the Invention

The present invention relates to a liquid ejecting head that ejects liquid such as ink, a method of manufacturing a liquid ejecting head, and a liquid ejection printing apparatus equipped with a liquid ejecting head, and more particularly, to a liquid ejecting head provided with a functional element, a method of manufacturing the liquid ejecting head, and a liquid ejection printing apparatus including the liquid ejecting head.

2. Description of the Related Art

It is known that a liquid ejecting head provided in a liquid ejection printing apparatus has a functional element. Japanese Patent Laid-Open No. 2002-79655 discloses a liquid ejecting head provided with a memory element as the functional element. In the configuration of Japanese Patent Laid-Open No. 2002-79655, a memory element is attached to the back face opposite the face where a wiring member (electric wiring tape) connects a printing element board including printing elements to various terminals on a contact board that electrically connects the liquid ejecting head and the liquid ejection printing apparatus.

Since the conducting portions of the terminals are exposed to the outside, the exposed portions are plated in order to prevent corrosion of the exposed portions. Electroplating is typically used for the plating, and involves applying a voltage to the conducting portions of the deposition target terminals when depositing the plating film. When electroplating, plating leads (wires) are required in order to apply a voltage to the conducting portions of the terminals.

Plating leads may be categorized into functional element-specific plating leads for plating the conducting portions of the terminals specific to functional elements, and other plating leads for plating the conducting portions of all other terminals. These plating leads are respectively disposed at positions on different edges of the contact board, and are respectively cut off from the contact board after being used as electrodes in the plating deposition step. Doing so exposes the cut edges of the plating leads at the edges of the contact board. If a conductive substance such as ink adheres to these cut edges, there is a risk of unexpected leaks or shorts between terminals.

In order to avoid this problem, the related art covers the cut edges of the plating leads for the terminals that transmit high-voltage printing element driving signals, with insulating resin or other material. Meanwhile, the cut edges of plating leads that apply a voltage to the conducting portions of the functional element-specific terminals are often not covered with insulating resin, because these leads transmit signals of low voltage compared to the printing element driving signals.

Recently, more various functional elements compared to previous functional elements have come to be used. For example, functional elements having signal terminals with long voltage application times compared to previous functional elements have come to be used. In these conditions, an apparatus is more susceptible to the effects of conductive substances adhering to the cut edges of functional element-specific plating leads compared to the case of using functional elements configured as in the related art. Consequently, also for the cut edges of plating leads used to plate the conducting portions of functional element-specific terminals, it is required to take some kind of measures for preventing leaks and shorts.

As discussed above, in an arrangement of the related art, the functional element-specific plating leads and the other plating leads are disposed on respectively different edges of the contact board. For this reason, additionally applying an insulating resin or other material to the cut edges of the functional element-specific plating leads requires adding a new step to the process of the related art, which only applies insulating resin to the cut edges of the other plating leads. Thus, there is a risk of lowering the manufacturing efficiency of the contact board, and by extension, of the liquid ejecting head.

SUMMARY OF THE INVENTION

The present invention has been devised in light of the above problems, and an object thereof is to provide a liquid ejecting head, a method of manufacturing a liquid ejecting head, and a liquid ejection printing apparatus, which are able to prevent conductive substances from adhering to the cut edges of plating leads for functional element-specific terminals, without lowering the manufacturing efficiency of the contact board, and by extension, the liquid ejecting head.

In order to solve the above problems, a liquid ejecting head according to the present invention includes a printing element board having a plurality of printing elements for producing energy used to eject liquid, a contact board having a contact terminal for electrically connecting to a liquid ejection printing apparatus, and a functional element, a plurality of lands which are provided on the face of the contact board where the functional element is mounted, and to which terminals of the functional element are connected, a wiring member that connects the printing element board to the contact board, a first terminal and a second terminal disposed on one edge of the contact board, a first wiring connecting the contact terminal to the first terminal, a second wiring connecting at least one of the plurality of lands to the second terminal, and insulating resin that covers the edge face of the second terminal positioned on the one edge of the contact board.

Also, a method of manufacturing a liquid ejecting head according to the present invention is a method of manufacturing a liquid ejecting head that includes a printing element board having a plurality of printing elements for producing energy used to eject liquid, and a contact board that is cut after partially plating wirings thereon, on which a contact terminal for electrically connecting to a liquid ejection printing apparatus, a functional element, a plurality of lands to which terminals of the functional element are connected, a first terminal, a second terminal, a first wiring connecting the contact terminal to the first terminal, and a second wiring connecting at least one of the plurality of lands to the second terminal are formed, and a wiring member that connects the printing element board to the contact board. The method includes forming the first terminal and the second terminal on the uncut contact board so as to be positioned at one edge of the cut contact board, plating the contact terminal and the plurality of lands, by using as electrodes the first terminal and the second terminal, cutting the contact board such that the cut edge of the second terminal is positioned at the one edge of the contact board, and applying insulating resin to cover the edge face of the second terminal positioned on the one edge of the cut contact board.

According to above configuration, a second terminal connected to at least one of multiple lands by a second wiring is disposed on one edge of a contact board at the same position of a first terminal connected to a contact terminal by a first wiring. In so doing, it is possible to cover the edge face (cut edge) of the second terminal (second wiring) disposed on this one edge by applying insulating resin to one edge of the contact board, similarly to a process of the related art. Thus, the present invention makes it possible to cover the edge face (cut edge) of a second terminal (second wiring) without adding a new processing step to a process of the related art.

Consequently, in the present invention it is possible to prevent conductive substances from adhering to the cut edges of leads used to plate the conducting portions of functional element-specific terminals, without lowering the manufacturing efficiency of the contact board, and by extension the liquid ejecting head, due to adding a new step to the process of the related art. Thus, in the present invention, it is possible to prevent malfunctions such as shorts and leaks between terminals caused by conductive substances adhering to the cut edges of the leads used to plate the conducting portions of functional element-specific terminals.

Further features of the present invention will become apparent from the following description of exemplary embodiments (with reference to the attached drawings).

DESCRIPTION OF THE EMBODIMENTS

Hereinafter, embodiments of the present invention will be described in detail and with reference to the drawings.

First Embodiment

Figure 1:
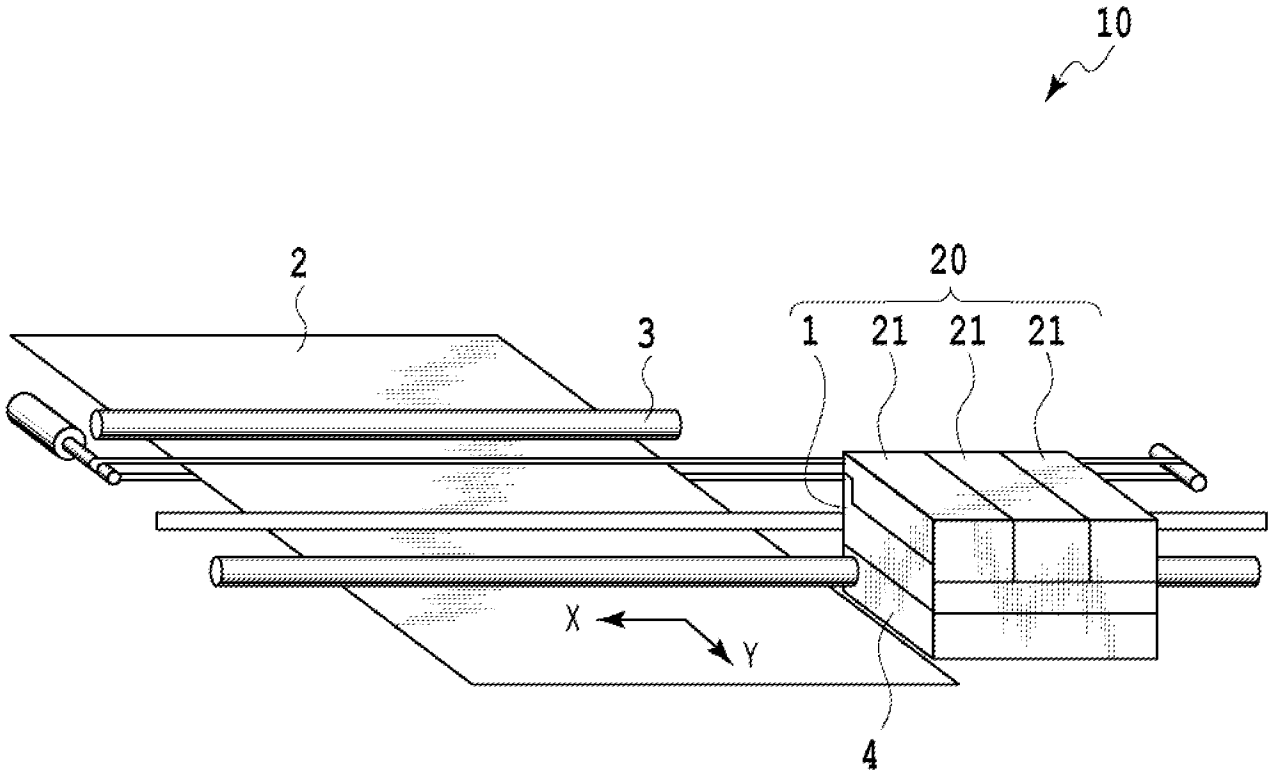
FIG. 1 is a diagrammatic perspective view illustrating a liquid ejection printing apparatus.

First, a configuration of a liquid ejection printing apparatus 10 (hereinafter designated the "printing apparatus 10") according to the present embodiment will be described. FIG. 1 is a diagrammatic perspective view illustrating a printing apparatus 10 according to the present embodiment. As illustrated in FIG. 1, the printing apparatus 10 is provided with a printing unit 20 and a transport roller 3. The printing unit 20 includes a liquid ejecting head 1 that ejects liquid such as ink, and ink tanks 21 that store ink. The liquid ejecting head 1 and the ink tanks 21 are removably mounted on a carriage 4. Although not illustrated, multiple nozzles are arrayed in the liquid ejecting head 1 along the sub-scan direction (the Y direction in FIG. 1). Multiple ink tanks 21 are provided, which supply internally stored ink to the liquid ejecting head 1.

An image is printed onto a print medium 2 by repeating a printing operation in which ink is ejected from the liquid ejecting head 1 while moving the printing unit 20 back and forth in a main scan direction (the X direction in FIG. 1) intersecting the Y direction, and a transport operation in which the print medium 2 is transported in the Y direction by the transport roller 3. In other words, the printing apparatus 10 prints an image onto the print medium 2 by moving the liquid ejecting head 1 and the print medium 2 relative to each other while ejecting ink from the liquid ejecting head 1.

Figure 2:
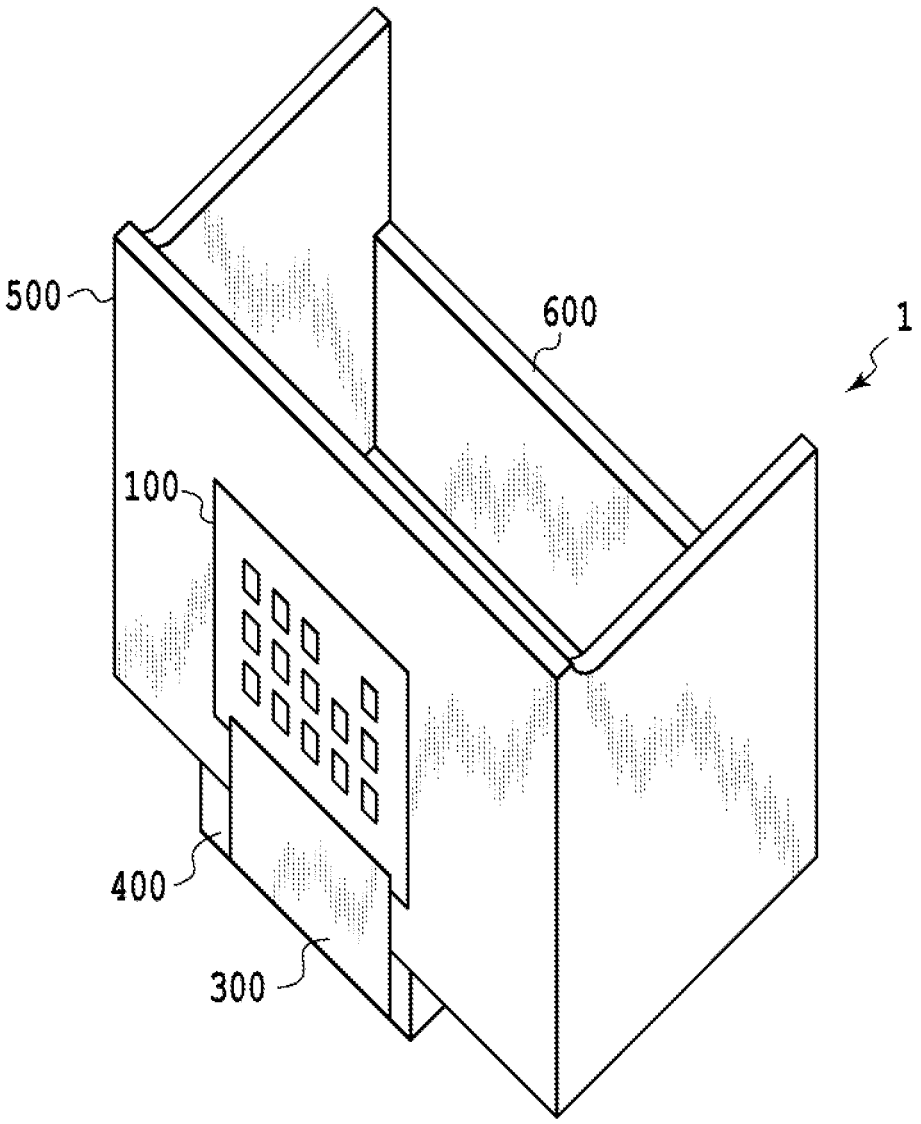
FIG. 2 is a diagrammatic perspective view illustrating a liquid ejecting head.

FIG. 2 is a diagrammatic perspective view illustrating a liquid ejecting head 1 according to the present embodiment. As illustrated in FIG. 2, the liquid ejecting head 1 is provided with a housing 500, a contact board 100, a wiring member 300, and a printing element board unit 400. The contact board 100, wiring member 300, and printing element board unit 400 are affixed to the housing 500. The housing 500 also includes a tank holder 600. The tank holder 600 is configured to carry the ink tanks 21 storing ink (see FIG. 1), and the housing 500 is internally provided with channels for supplying ink from the ink tanks 21 to the printing element board unit 400.

The contact board 100 is connected to a contact board (not illustrated) on the carriage 4 when the liquid ejecting head 1 is installed on the carriage 4. The contact board on the carriage 4 is electrically connected to a control circuit in the printing apparatus 10 via a flexible cable (not illustrated). Although later discussed in detail, the contact board 100 is provided with various terminals.

The printing element board unit 400 is provided with a printing element board (not illustrated). The printing element board includes multiple printing elements, which act as ejection energy-producing elements which produce energy for ejecting ink from the nozzles. Mutually connecting channels are formed in the housing 500 and the printing element board unit 400, and ink inside the ink tanks 21 is supplied to the positions of the printing elements via the channels in the housing 500 and the channels in the printing element board unit 400.

Ink ejection control is applied according to printing element driving signals transmitted from a control circuit in the printing apparatus 10, and an image is printed onto the print medium 2 by ejecting ink from the nozzles in accordance with this control. Elements such as electrothermal transducers (heaters) or piezo elements may be used as the printing elements. In the case of using heaters, a bubble may be formed in the ink due to the generated heat, and this bubble energy may be used to eject ink from a nozzle.

The wiring member 300 electrically connects signal terminals on the contact board 100 to electrodes on the printing element board. In other words, electrical signals transmitted from the printing apparatus 10 (including printing element driving signals) are transmitted to the printing element board of the printing element board unit 400 via the contact board 100 and the wiring member 300. In the present embodiment, the wiring member 300 is disposed along one edge of the contact board 100 so as to partially cover the contact board 100 and the printing element board unit 400 provided with the printing element board. Note that electric wiring tape may be used as the wiring member 300.

By taking a configuration like the above, signals from the printing apparatus 10 are transmitted to the printing element board of the printing element board unit 400 via the contact board 100 and the wiring member 300. Note that in FIG. 2, a simplified contact board 100 is illustrated. A detailed configuration of the contact board 100 is described below with reference to FIGS. 3A and 3B.

Figure 3A:
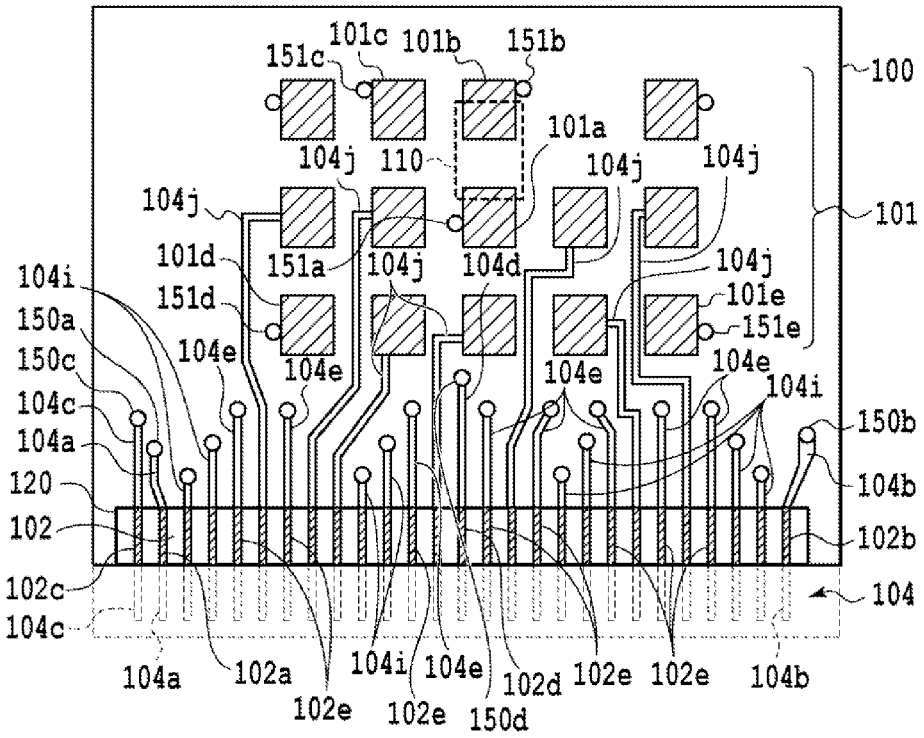
FIG. 3A is a schematic diagram illustrating a wiring layer according to the first embodiment.
Figure 3B:
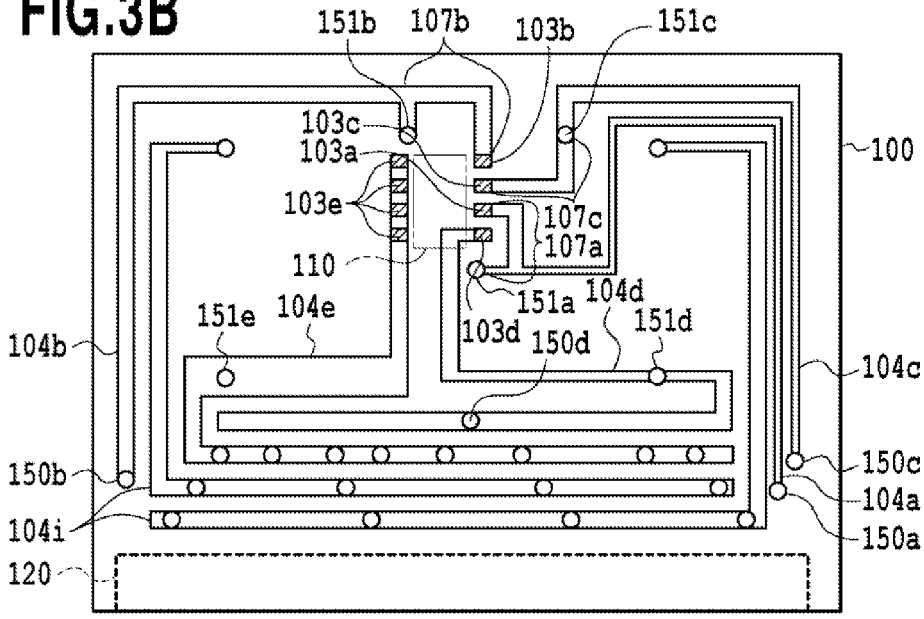
FIG. 3B is a schematic diagram illustrating a wiring layer according to the first embodiment.

The contact board 100 includes the two wiring layers of a front layer and a back layer. FIGS. 3A and 3B are schematic diagrams illustrating wiring layers of the contact board 100 in the present embodiment. FIG. 3A illustrates the face provided with a contact terminal group 101 (front face), while FIG. 3B illustrates the face on which a memory element 110 is mounted (back face).

Although the present embodiment describes the case of using a memory element 110 as the functional element, the functional element used in the present invention is not limited thereto. For example, a head control chip element may also be used as the functional element. Note that in the following, the term "wirings 104" will be collectively used when describing the entirety of the wirings 104 formed by the wiring layers on the front and back of the contact board 100, whereas individually assigned reference signs will be used when describing individual wiring among the wirings 104.

First, the front layer of the contact board 100 will be described. As illustrated in FIG. 3A, a contact terminal group 101 is provided on the front layer of the contact board 100. The contact terminal group 101 is connected to a contact terminal group of the contact board (not illustrated) on the carriage 4 when the liquid ejecting head 1 is installed on the carriage 4, and is thus a group of external signal input terminals that receive electrical signals from the printing apparatus 10.

In the present embodiment, the contact terminal group 101 includes a total of 14 contact terminals, including contact terminals 101*a* to 101*e*. In other words, in the present embodiment, multiple contact terminals are formed on the contact board 100. The contact terminals are arranged in a 3 row by 5 column array when viewing FIG. 3A from the front, with two terminals disposed vertically in the second column from the right, and three terminals disposed vertically in the other four columns.

In the present embodiment, the contact terminal group 101 may be subdivided into three parts by application. As discussed later, the contact terminals 101*a* to 101*c* are respectively connected to corresponding signal terminals 102*a* to 102*c* (second terminals) in a signal terminal array 102 via wirings 104*a* to 104*c* (second wirings, second terminals) on the front and back of the contact board 100. These contact terminals 101*a* to 101*c* are used to transmit signals between the printing apparatus 10 and the memory element 110.

As discussed later, the contact terminals 101*d* and 101*e* are respectively connected to corresponding signal terminals 102*d* and 102*e* (second terminals) in a signal terminal array 102 via wirings 104*d* and 104*e* (second wirings, second terminals) on the front and back of the contact board 100. These contact terminals 101*d* and 101*e* are used to transmit signals back and forth among the printing apparatus 10, the memory element 110, and the printing element board.

As discussed later, the contact terminals other than the above are respectively connected to corresponding signal terminals (first terminals) in a signal terminal array 102 via wirings 104*i* and 104*j* (first wirings) on the front and back of the contact board 100. These contact terminals are used to transmit signals between the printing apparatus 10 and the printing element board.

Also, as illustrated in FIG. 3A, a signal terminal array 102 is provided in the portion near one edge (the lower portion in FIG. 3A) of the contact board 100. The signal terminal array 102 is made up of multiple signal terminals disposed perpendicular to the one edge of the contact board 100 and arrayed along the one edge.

A wiring member connection region 120 is provided near the one edge of the contact board 100 in the region where the signal terminal array 102 is provided in the front layer of the contact board 100.

Bonded to the wiring member connection region 120 is the wiring member 300 for electrically connecting the signal terminals of the contact board 100 and the printing element board of the printing element board unit 400.

In the present embodiment, when resist coating the front face of the contact board 100, a mask covering the contact terminal group 101 and the wiring member connection region 120 is used to resist coat all areas of the contact board 100 other than the contact terminal group 101 and the wiring member connection region 120. In the present embodiment, parts of the wirings 104, or in other words the parts of the wirings 104 positioned in the wiring member connection region 120 are exposed on the contact board 100 and used as signal terminals.

Also, on the back face of the contact board 100, all areas other than a land group 103 (lands 103*a* to 103*e*) discussed later are resist coated. After that, the exposed contact terminal group 101, signal terminal array 102, and land group 103 on the front and back faces of the contact board 100 are electroplated.

In the present embodiment, the contact terminal group 101, the multiple signal terminals constituting the signal terminal array 102, and the land group 103 are connected by the wirings 104. A specific connection method will be discussed later, but the wirings 104 are wirings that individually connect the contact terminal group 101 to multiple signal terminals, while also being wirings used as the plating leads when plating the surfaces of the contact terminal group 101 and the land group 103 (the exposed conducting portions). In other words, the wirings 104 are also used as electrodes when plating the connection terminals at the end of each wiring.

After plating the connection terminals, the broken line portion extending from the one edge of the contact board 100 as illustrated in FIG. 3A is severed together with the wirings 104 formed in that portion, and the unneeded portion is cut away from the contact board 100. Consequently, the cut edges of the wirings 104 are exposed on the lateral face along the one edge of the severed contact board 100.

The memory element 110 is mounted on the back face of the broken line portion that includes parts of the regions of the contact terminal 101*a* and the contact terminal 101*b* as illustrated in FIG. 3A. Next, the back layer of the contact board 100 will be described. FIG. 3B is a diagram illustrating the state of the back face of the contact board 100 illustrated in FIG. 3A as viewed by turning over the contact board 100 left-to-right. On the back face of the contact board 100, the memory element 110 is mounted at the location indicated by the chain lines in FIG. 3B.

As illustrated in FIG. 3B, a land group 103 (lands 103*a* to 103*e*) are provided for mounting the memory element 110 on the back face of the contact board 100, and the terminals of the memory element 110 are connected to these lands. FIG. 3B illustrates the back face of the contact board 100 before mounting the memory element 110.

In the present embodiment, I2C electrically erasable and programmable read-only memory (EEPROM) may be used as the memory element 110. Although not illustrated, the memory element 110 includes eight terminals. The lands 103*a*, 103*b*, 103*c*, and 103*d* illustrated in FIG. 3B are respectively connected to a write protect terminal (WP), a data input/output terminal (SDA), a clock terminal (SCL), and a power supply terminal (VCC). The land 103*e* illustrated in FIG. 3B is connected to a ground terminal (GND) and three address terminals (A0, A1, and A2).

Next, the wiring patterns on the contact board 100 will be described more specifically. As illustrated in FIGS. 3A and 3B, multiple through-holes penetrating through the front layer and the back layer are provided in the contact board 100. The contact terminals 101*a* to 101*c* that connect to terminals of the memory element 110 without connecting to the printing element board are respectively connected to the lands 103*a* to 103*c* by wirings 107*a* to 107*c* via through-holes 151*a* to 151*c*.

The contact terminal 101*d* is connected to the land 103*d* by a wiring on the back face (given the same reference sign 104*d*) which is connected to a wiring 104*d* on the front face of the contact board 100, via a through-hole 151*d*. The contact terminal 101*d* is also connected to a signal terminal 102*d* by the wiring 104*d*. The contact terminal 101*e* is connected to the land 103*e* by a wiring on the back face (given the same reference sign 104*e*) which is connected to a wiring 104*e* on the front face of the contact board 100, via a through-hole 151*e*. The contact terminal 101*e* is also connected to a signal terminal 102*e* by the wiring 104*e*.

In other words, for the contact terminals 101*d* and 101*e*, the same wiring is used for connecting to a land as well as for connecting to a signal terminal.

The wirings 104*a* to 104*c* on the front face of the contact board 100 are connected from the wiring member connection region 120 illustrated in FIG. 3A to the lands 103*a* to 103*c* by wirings on the back face (given the same reference signs 104*a* to 104*c*) via through-holes 150*a* to 150*c*.

The wiring 104*a* is used as a plating lead when plating the land 103*a*, the contact terminal 101*a*, and the signal terminal 102*a*. Similarly, the wiring 104*b* is used as a plating lead when plating the land 103*b*, the contact terminal 101*b*, and the signal terminal 102*b*, while the wiring 104*c* is used as a plating lead when plating the land 103*c*, the contact terminal 101*c*, and the signal terminal 102*c*.

These wirings 104*a* to 104*c* are used as electrodes when plating the surfaces (the exposed conducting portions) of the lands 103*a* to 103*c* and the contact terminals 101*a* to 101*c*, which are the terminals specifically for the memory element 110. In the present embodiment, measures are taken to prevent conductive substances from adhering to the cut edges (edge faces) of these wirings 104*a* to 104*c*.

The wirings 104*d* are used as electrodes when plating the land 103*d*, the contact terminal 101*d*, and the signal terminal 102*d*. Similarly, the wirings 104*e* are used as electrodes when plating the land 103*e*, the contact terminal 101*e*, and the signal terminal 102*e*.

The wirings 104*j* connect contact terminals and signal terminals not connected to the lands 103, without passing through a through-hole. The wirings 104*i* connect contact terminals and signal terminals not connected to the lands 103, via a through-hole. These wirings 104*i* and 104*j* are used as electrodes when plating corresponding contact terminals and signal terminals.

When the wiring member 300 is bonded collectively to multiple signal terminals at the wiring member connection region 120, there is a risk that the bonding pressure on the signal terminals may become unstable. Such bonding pressure tends to be greater for signal terminals positioned at the ends of the signal terminal array 102 compared to signal terminals positioned in the center.

Consequently, in the present embodiment, the signal terminals 102*a* to 102*c*, which are parts of the wirings 104*a* to 104*c* connecting the contact terminals 101*a* to 101*c* (which are not connected to terminals on the printing element board) to signal terminals on the contact board 100, are disposed on the edges of the signal terminal array 102 in the layout direction.

In other words, the signal terminals 102*a* to 102*c*, which are parts of the wirings 104*a* to 104*c* and specific to the memory element 110 that is not connected to terminals on the printing element board, are disposed on the ends of the signal terminal array 102 in the layout direction. Thus, the signal terminals that connect to terminals on the printing element board are disposed near the center of the signal terminal array 102, and it is possible to make the bonding pressure applied to these terminals more stable. As a result, it is possible to consistently transmit electrical signals (including printing element driving signals) between the signals terminals on the contact board 100 and the printing element board.

In configurations of the related art, measures were taken only for the cut edges of the plating leads for terminals that connect to the printing element board. In the present invention, measures are also taken for the cut edges of the plating leads of terminals that connect to terminals of a functional element, without connecting to the printing element board. Thus, in the present embodiment, measures are taken for the cut edges of all wirings 104. Hereinafter, the state of the cut edges of the wirings 104 in the present embodiment will be described.

Figure 4A:
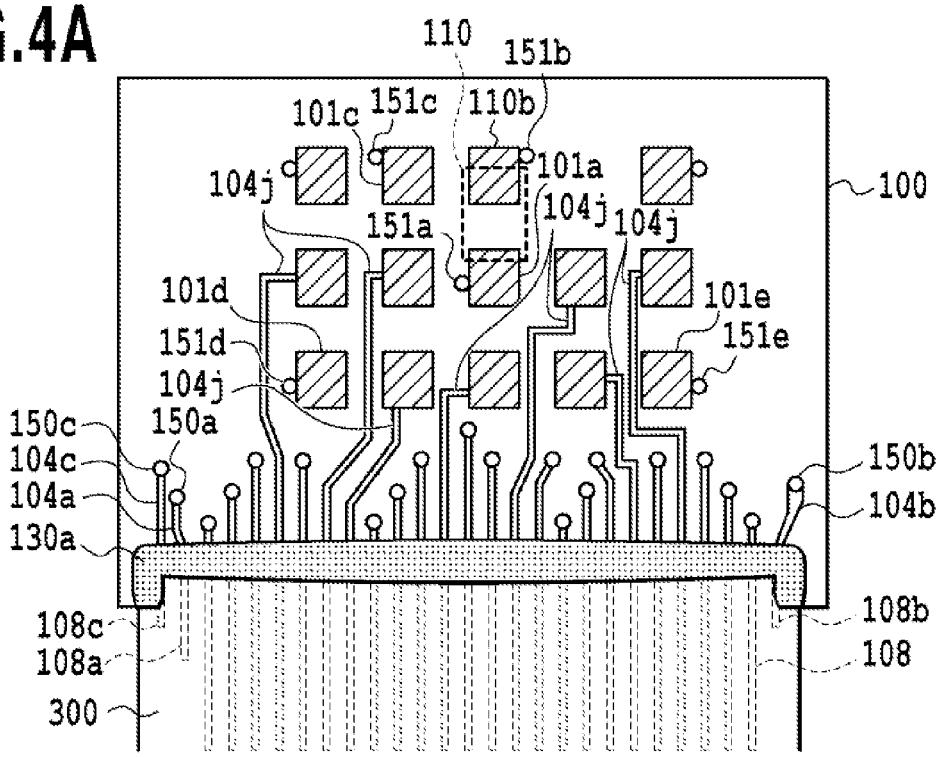
FIG. 4A is a schematic diagram illustrating the connection state between a board and a wiring member.
Figure 4B:
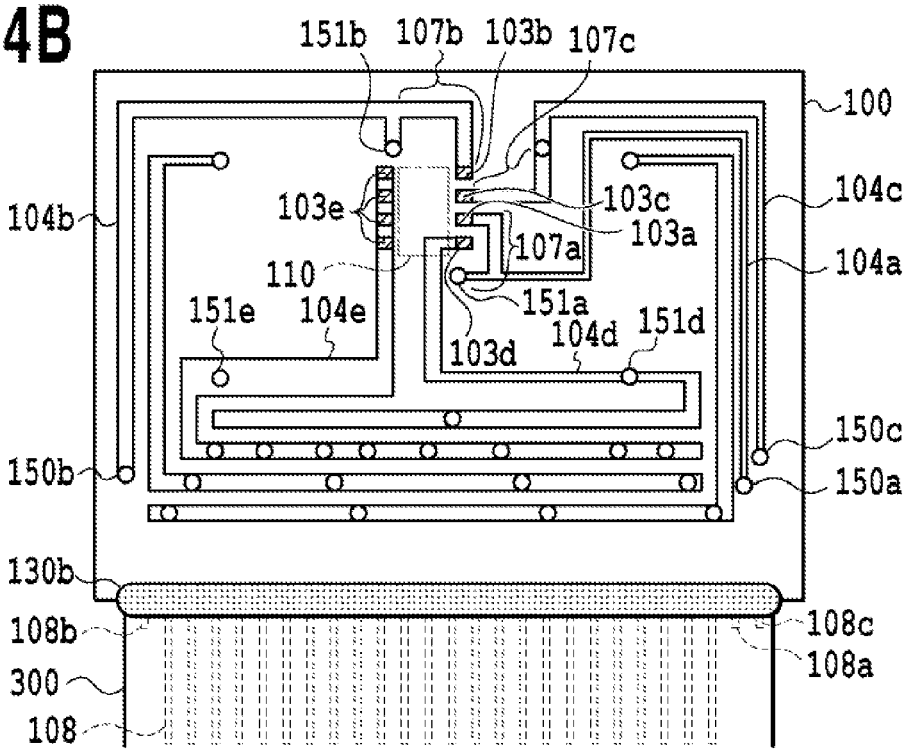
FIG. 4B is a schematic diagram illustrating the connection state between a board and a wiring member.

FIGS. 4A and 4B are schematic diagrams illustrating connection states between the contact board 100 and the wiring member 300. In FIGS. 4A and 4B, parts of the wirings 104 extending from the one edge of the contact board 100 illustrated in FIG. 3A have been cut, and the wiring member 300 is connected to the wiring member connection region 120 positioned at the one edge. Additionally, these connections portions are configured so as to not expose the cut edges of the wirings 104.

Specifically, on the front layer of the contact board 100, the boundary region between the contact board 100 and the wiring member 300 is covered by an insulating resin 130*a* so that conductive substances do not infiltrate the connection portions between the signal terminal array 102 and the wiring member 300, as illustrated in FIG. 4A. As illustrated in FIG. 4B, on the back layer of the contact board 100, the cut edges of the wirings 104 exposed on the back face are covered by an insulating resin 130*b*.

Note that in FIGS. 4A and 4B, the wirings 108 illustrated inside the wiring member 300 are wirings for joining the signal terminals (which are part of the wirings 104) to the printing element board. As discussed earlier, in the present embodiment, the signal terminals 102*a* to 102*c* specific to the memory element 110 are not connected to the printing element board. For this reason, the wirings 108*a* to 108*c* inside the wiring member 300 which are connected to these signal terminals 102*a* to 102*c* are shorter than the other wirings 108 and stop partway inside the wiring member 300, as illustrated in FIGS. 4A and 4B.

As discussed earlier, all signal terminals are plated, including these signal terminals 102*a* to 102*c*, and the portions extending downward from the one edge of the contact board 100 in FIG. 3A are cut. For this reason, these cut edges are not plated and become exposed at the edge of the contact board 100.

As discussed earlier, FIG. 4A illustrates the state where the boundary portion between the contact board 100 and the wiring member 300 is covered by an insulating resin 130*a* on the front face of the contact board 100. As illustrated in FIG. 4A, the insulating resin 130*a* is applied to the boundary portion between the contact board 100 and the wiring member 300, and prevents the infiltration of conductive substances into the connection portion between the signal terminals and the wiring member. As illustrated in FIG. 4B, an insulating resin 130*b* covers the cut edges of the wirings 104 at the edge of the contact board 100 on the back layer of the contact board 100, so as to not expose the cut edges.

In the present embodiment, by directly or indirectly covering the cut edges of the wirings 104 with insulating resin 130*a* and 130*b* so as to not expose the cut edges to the outside, it is possible to eliminate the risk of leaks and shorts due to conductive substances such as ink adhering to these cut edges.

Also, in the present embodiment, all signal terminals, including the signal terminals 102*a* to 102*c* specific to the memory element 110, are disposed concentrated at the portion near the one edge of the contact board 100. For this reason, covering the wirings 104 with the insulating resin 130*a* and 130*b* is conducted by respectively applying insulating resin 130 one time each to the front and back faces of the contact board 100. Thus, it is not necessary to add additional steps compared to processes of the related art which only cover the cut edges of connecting wirings/plating leads for terminals connecting to the printing element board.

Consequently, in the present embodiment it is possible to prevent conductive substances from adhering to the cut edges of leads used to plate the conducting portions of functional element-specific terminals, without lowering the manufacturing efficiency of the contact board, and by extension the liquid ejecting head, due to adding a new processing step. Thus, in the present embodiment, it is possible to prevent malfunctions such as shorts and leaks between terminals caused by conductive substances adhering to the cut edges of the leads used to plate the conducting portions of functional element-specific terminals.

Second Embodiment

In the first embodiment, respective portions of all wirings 104 are used as signal terminals. The present embodiment differs from the first embodiment in that respective portions of the wirings 104*a* to 104*c* are not used as signal terminals and do not connect to the wiring member 300. Other aspects of the configuration are similar to the first embodiment, and thus their description will be omitted.

Figure 5A:
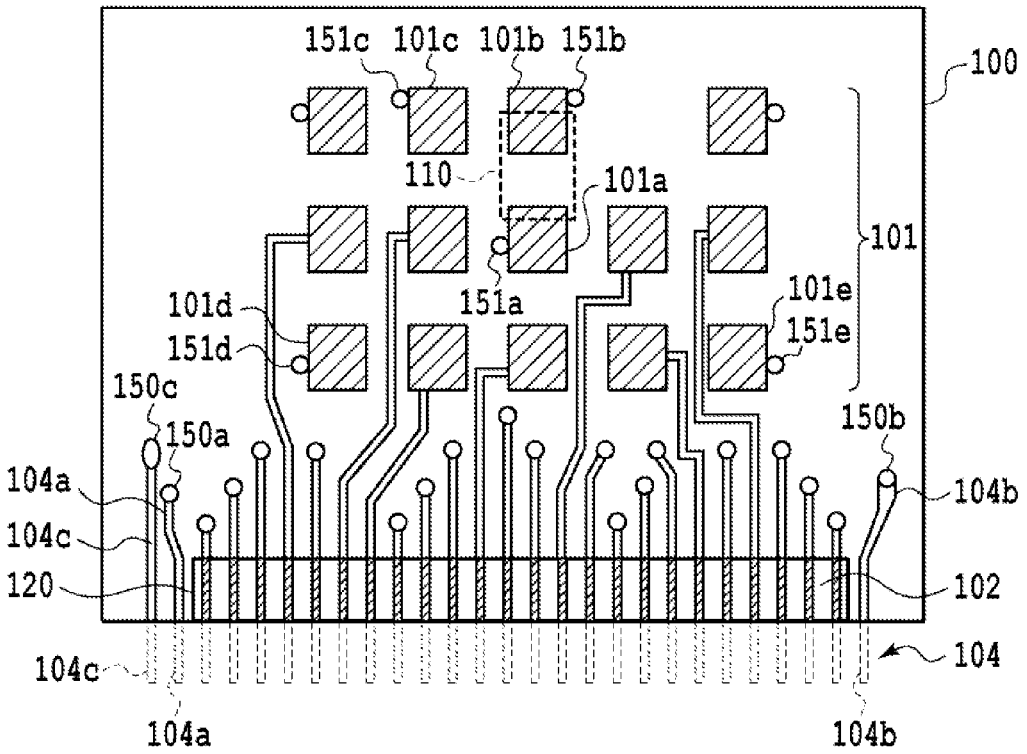
FIG. 5A is a schematic diagram illustrating a wiring layer according to the second embodiment.
Figure 5B:
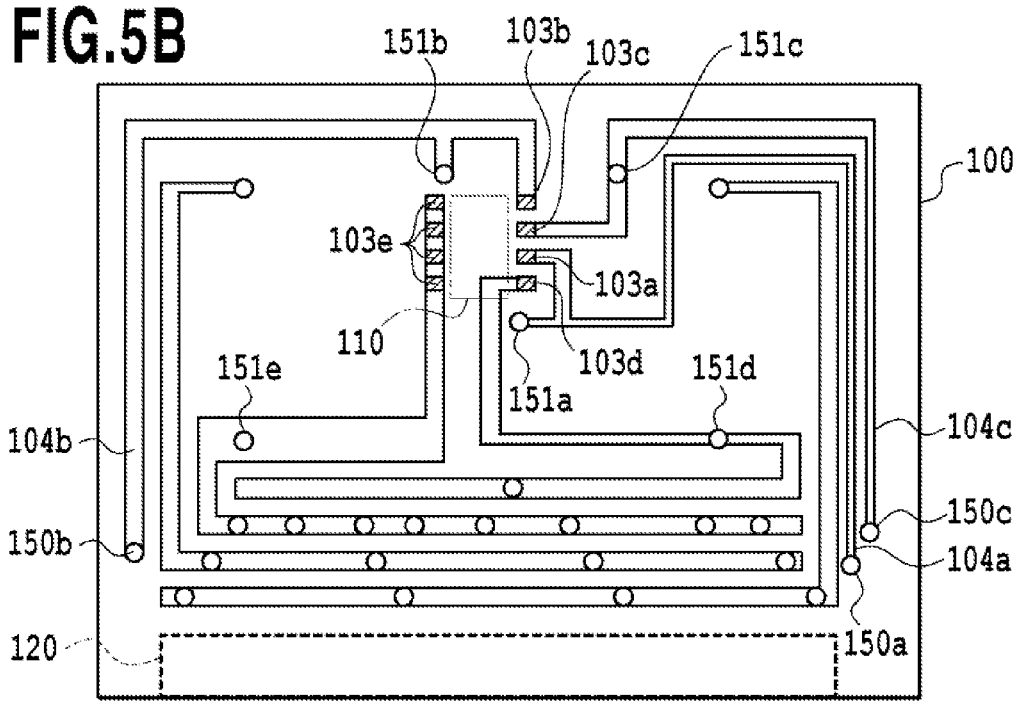
FIG. 5B is a schematic diagram illustrating a wiring layer according to the second embodiment.

FIGS. 5A and 5B are schematic diagrams illustrating wiring layers according to the present embodiment. FIG. 5A illustrates the face provided with a contact terminal group 101 (front face), while FIG. 5B illustrates the face on which a memory element 110 is mounted (back face). As illustrated in FIG. 5A, the wirings 104*a* to 104*c* used to plate the lands 103*a* to 103*c* are disposed at the ends of the array made up of the wirings 104. The wirings 104*c* and 104*a* are disposed from the left edge in that order when viewing FIG. 5A from the front, while the wiring 104*b* is disposed on the right edge.

As discussed above, the respective portions of the wirings 104*a* to 104*c* are not used as signal terminals in the present embodiment. For this reason, when resist coating the contact board 100, resist is also applied to the parts of the wirings 104*a* to 104*c* which do not receive resist in the first embodiment.

Since portions of the wirings 104*a* to 104*c* are not used as signal terminals in the present embodiment, the number of signal terminals may be reduced compared to the first embodiment. Consequently, the width of the signal terminal array 102 may be made narrower compared to the first embodiment. Thus, since the width of the wiring member 300 that connects to the signal terminal array 102 may be made narrower compared to the first embodiment, the manufacturing costs of the wiring member 300 may be lowered. Accordingly, it is also possible to reduce the size of the printing element board unit connected to the wiring member 300 compared to a configuration of the related art.

With this configuration, applying the insulating resin 130*a* and 130*b* makes it possible to prevent malfunctions such as leaks between terminals which may occur due to conductive substances adhering to the cut edges of the wirings 104, similarly to the first embodiment.

Third Embodiment

In the first and second embodiments, all wirings 104 are disposed at the one edge of the contact board 100. In the present embodiment, wirings 104*b* and 104*c* (third wirings) are disposed at the portion near another edge that is opposite to the one edge where the wirings 104 are disposed in the first and second embodiments, and only on the back face of the contact board 100. The cut edges of the wirings 104*b* and 104*c* are not covered by insulating resin.

In addition, in the present embodiment, portions of the wirings 104*a* to 104*c* are not used as signal terminals and do not connect to the wiring member 300, similarly to the second embodiment. Other aspects of the configuration are similar to the first and second embodiments, and thus their description will be omitted.

Figure 6A:
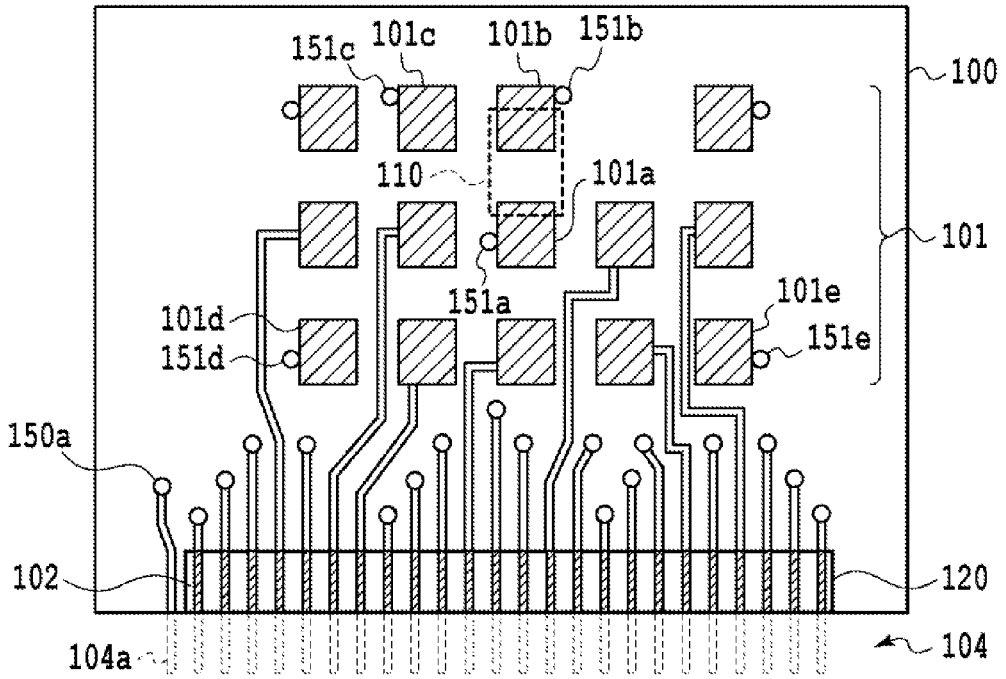
FIG. 6A is a schematic diagram illustrating a wiring layer according to the third embodiment.
Figure 6B:
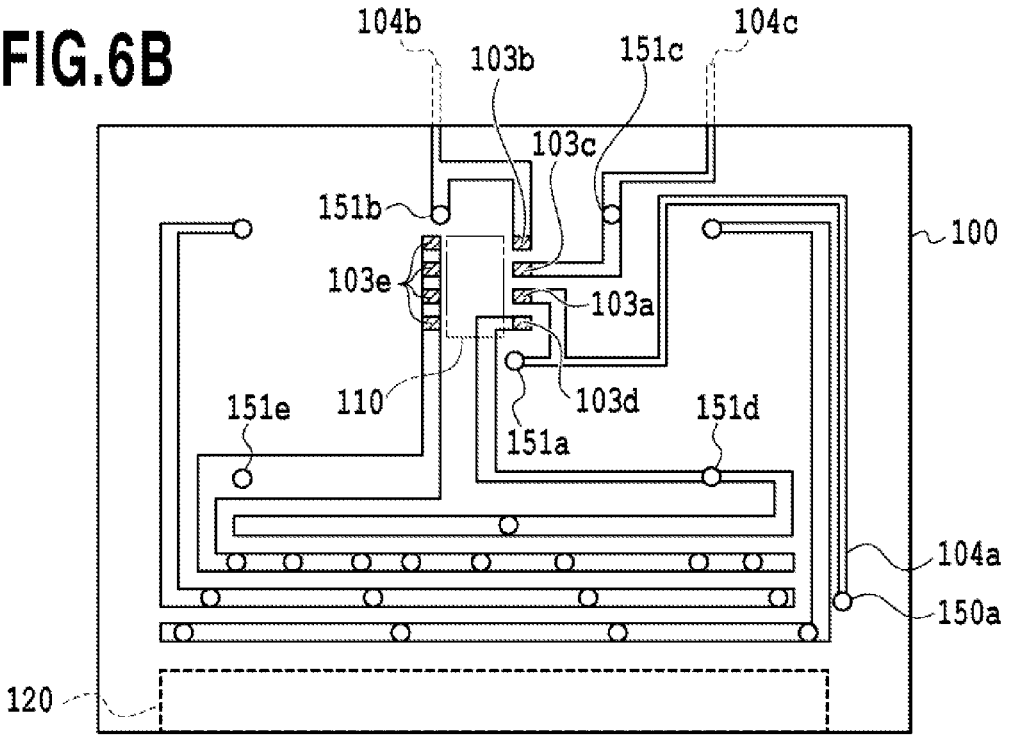
FIG. 6B is a schematic diagram illustrating a wiring layer according to the third embodiment.

FIGS. 6A and 6B are schematic diagrams illustrating wiring layers according to the present embodiment. FIG. 6A illustrates the face provided with a contact terminal group 101 (front face), while FIG. 6B illustrates the face on which a memory element 110 is mounted (back face). Among the array of wirings 104, the wiring 104*a* is disposed on the left edge when viewing FIG. 6A from the front. Also, as illustrated in FIG. 6B, the wirings 104*b* and 104*c* are provided on the back face of the contact board 100, and at the portion near edge that is opposite to the one edge where the signal terminal array 102 is provided on the contact board 100.

As illustrated in FIG. 6A, the wiring 104*a* is connected to the land 103*a* illustrated in FIG. 6B from the one edge where the signal terminal array 102 is provided on the contact board 100, via a through-hole 150*a*.

The wirings 104*b* and 104*c* are respectively connected to the lands 103*b* and 103*c*, from the back face of the contact board 100 illustrated in FIG. 6B, and at the portion near edge that is opposite to the one edge where the wiring member connection region 120 is provided on the contact board 100 illustrated in FIG. 6A. In other words, the wirings 104*b* and 104*c* have one end disposed at an edge of the contact board 100 other than the one edge where the other wirings are disposed, with the other end connected to the lands 103*b* and 103*c*, respectively.

During printing operation by the liquid ejecting head 1, a write-protect process is performed on the memory element 110 mounted on the liquid ejecting head 1. At this time, the signal transmitted to the contact terminal 101*a* is kept locked to a high signal, and voltage is constantly applied. For this reason, the probability of a leak or short occurring in the case where a conductive object such as ink has adhered to the cut edge of the wiring 104*a* is higher than the probability of a leak or other malfunction occurring due to a conductive substance adhering to the cut edge of a wiring for a contact terminal to which voltage is infrequently applied.

Consequently, in the present embodiment, the wiring 104*a* is disposed at the one edge of the contact board 100 where the signal terminal array 102 is provided, and its cut edge is directly or indirectly covered with insulating resin 130*a* and 130*b*, similarly to the first and second embodiments.

On the other hand, a voltage is applied to the contact terminals 101*b* and 101*c* only when a data read/write process is conducted by the control circuit of the printing apparatus 10. Since voltage is applied to the contact terminals 101*b* and 101*c* less frequently than the contact terminal 101*a*, the probability of a leak or short occurring is also low.

Consequently, in the present embodiment, the cut edges of the wirings 104*b* and 104*c* are not covered with insulating resin. For this reason, the wirings 104*b* and 104*c* are disposed on the back face of the contact board 100, and at the portion near another edge that is opposite to the one edge of the contact board 100 where the signal terminal array 102 is provided. On the other hand, since the cut edge of the wiring 104*a* is covered with insulating resin, with this configuration it is likewise possible to prevent leaks and shorts.

Likewise in the present embodiment, since the cut edge is covered only the wiring 104*a* disposed near the one edge where the signal terminal array 102 is provided on the contact board 100, it is not necessary to add a new processing step compared to a process of the related art. Thus, by using insulating resin to cover the cut edge of a wiring disposed near the one edge with the signal terminal array from among the cut edges of the wirings (plating leads) specific to the memory element, it is possible to prevent malfunctions such as leaks between terminals, without lowering manufacturing efficiency.

Fourth Embodiment

In the third embodiment, the wirings 104*b* and 104*c* are disposed on the back face of the contact board 100, and at the portion near another edge that is opposite to the one edge where the signal terminal array 102 is provided on the contact board 100. The fourth embodiment differs from the third embodiment in that only the wiring 104*c* is disposed on the back face of the contact board 100, and at the portion near another edge that is opposite to the one edge where the signal terminal array 102 is provided on the contact board 100. The fourth embodiment also differs from the third embodiment in that only the cut edge of the wiring 104*c* is not covered with resin.

Furthermore, the present embodiment differs from the third embodiment in that the wiring 104*b* is disposed on the opposite end from where the wiring 104*a* is disposed in the third embodiment. Other aspects of the configuration are similar to the above embodiments, and thus their description will be omitted.

Figure 7A:
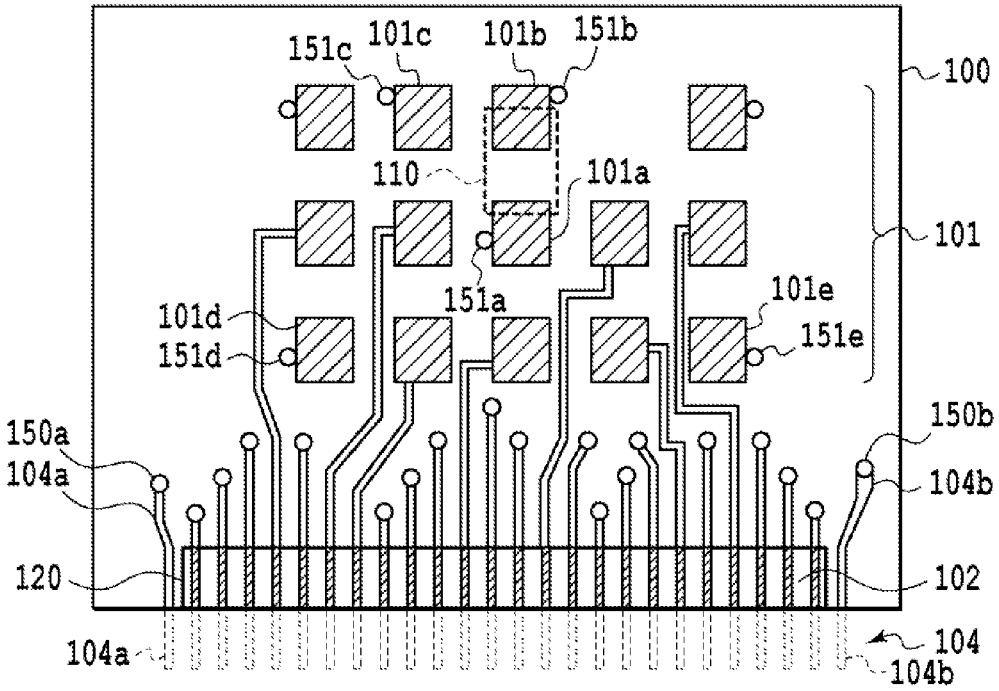
FIG. 7A is a schematic diagram illustrating a wiring layer according to the fourth embodiment.
Figure 7B:
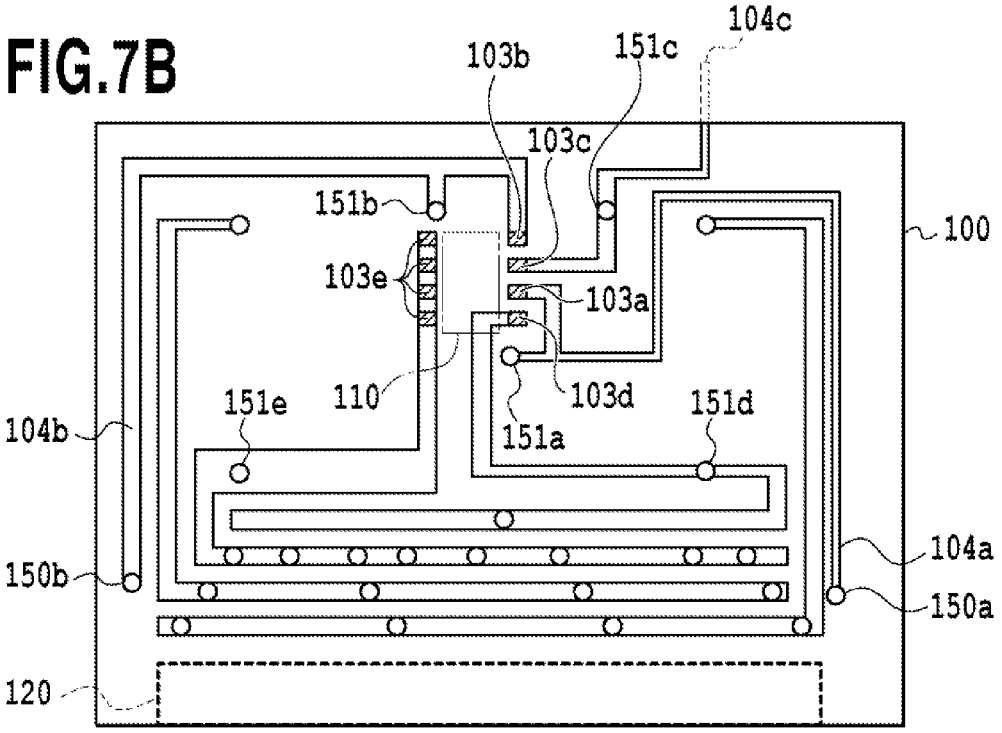
FIG. 7B is a schematic diagram illustrating a wiring layer according to the fourth embodiment.

FIGS. 7A and 7B are schematic diagrams illustrating wiring layers according to the present embodiment. FIG. 7A illustrates the face provided with a contact terminal group 101 (front face), while FIG. 7B illustrates the face on which a memory element 110 is mounted (back face). In the present embodiment, among the array of wirings 104, the wiring 104*a* is disposed on the left edge when viewing FIG. 7A from the front, whereas the wiring 104*b* is disposed on the right edge. Otherwise, the wiring 104*c* is disposed on the back face of the contact board 100, and at the portion near another edge that is opposite to the one edge where the signal terminal array 102 is provided on the contact board 100, as illustrated in FIGS. 7A and 7B.

Unlike the third embodiment, in the present embodiment, only the wiring 104*c* is disposed on the back face of the contact board 100, and at the portion near another edge that is opposite to the one edge where the signal terminal array 102 is provided on the contact board 100. In so doing, it is possible to prevent electrical continuity among the cut edges of multiple wirings 104 via ink droplets.

Also, in the present embodiment, insulating resin is used to cover the cut edges of the wirings 104*a* and 104*b* disposed near the one edge where the signal terminal array 102 is provided on the contact board 100. On the other hand, insulating resin does not cover the cut edge of the wiring 104*c* disposed on the edge opposite to the one edge where the signal terminal array 102 is disposed. In other words, in this constitution, insulating resin is likewise used to directly or indirectly cover the cut edges of the wirings 104*a* and 104*b* disposed near the one edge with the signal terminal array 102 on the contact board 100. In so doing, it is possible to prevent malfunctions such as leaks between terminals, without adding a new processing step to a process of the related art.

Other Embodiments

Note that although the foregoing embodiments describe a configuration that provides a contact board 100 on a liquid ejecting head 1, the present invention is not limited to this configuration. For example, it is possible to provide multiple apertures in a partial region of an insulating film on the front face of the wiring member 300 (the face opposite the face bonded to the liquid ejecting head 1), and make these multiple apertures the contact terminal group 101 and the signal terminals. In this case, wirings inside the wiring member 300 are exposed as terminals from the apertures, and the exposed wirings are used as respective contact terminals and signal terminals. Additionally, the memory element 110 is mounted onto the face provided with the above apertures, or on the back face.

By taking such a configuration, it is possible to use a partial region of an insulating film on the front face of the wiring member 300 as a substitute for the contact board 100 in a configuration that does not provide the contact board 100 on the liquid ejecting head 1.

Although 14 contact terminals are provided in the foregoing embodiments, the number of contact terminals is not limited thereto, and the number of contact terminals may be greater or less than the above.

In the foregoing embodiments, the signal terminal array 102 is disposed perpendicular to the one edge of the contact board 100, but the signal terminal array 102 need not be disposed strictly perpendicular to the one edge of the contact board 100.

Also, in the third and fourth embodiments, wirings such as the wiring 104*c* are disposed on an edge opposite to the one edge where the signal terminal array 102 is provided on the contact board 100. However, the wirings 104*b* and 104*c* are not necessarily required to be positioned opposite to the one edge where the signal terminal array 102 is provided on the contact board 100, and may also be positioned on another edge other than the one edge where the signal terminal array 102 is provided on the contact board 100.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-103792, filed Apr. 27, 2012, which is hereby incorporated by reference herein in its entirety.

What is claimed is:

1. A liquid ejecting head comprising:

a printing element board having a plurality of printing elements for producing energy used to eject liquid;

a contact board having a contact terminal for electrically connecting to a liquid ejection printing apparatus, and a memory element;

a plurality of lands which are provided on a face of the contact board where the memory element is mounted, and to which terminals of the memory element are connected;

a wiring member that connects the printing element board to the contact board;

a plurality of first terminals and a plurality of second terminals disposed on one edge of the contact board, wherein the plurality of second terminals are disposed at the end of a first terminal array in which the plurality of first terminals are arrayed;

a first wiring connecting the contact terminal to the first terminals;

a second wiring connecting at least one of the plurality of lands to the second terminals; and insulating resin that covers edge faces of the second terminals positioned on the one edge of the contact board.

2. The liquid ejecting head according to claim 1, wherein the first terminals and the second terminals are respectively formed of the first wiring and the second wiring.

3. The liquid ejecting head according to claim 1, further comprising:

a third wiring having one end disposed on another edge other than the one edge of the contact board, and the other end connected to one of the plurality of lands.

4. The liquid ejecting head according to claim 1, wherein a part of the wiring member comprises the contact board.

5. A liquid ejection printing apparatus comprising:

the liquid ejecting head according to any one of claims 1, 2, 3 and 4; and means for moving the liquid ejecting head and a printing medium relative to each other.

6. A method of manufacturing a liquid ejecting head that includes a printing element board having a plurality of printing elements for producing energy used to eject liquid, and a contact board that is cut after partially plating wirings thereon, on which a contact terminal for electrically connecting to a liquid ejection printing apparatus, a memory element, a plurality of lands to which terminals of the memory element are connected, a plurality of first terminals, a plurality of second terminals, a first wiring connecting the contact terminal to the first terminals, and a second wiring connecting at least one of the plurality of lands to the second terminals are formed, and a wiring member that connects the printing element board to the contact board, the method comprising:

forming the first terminals and the second terminals on the uncut contact board so as to be positioned at one edge of the cut contact board and so that the plurality of second terminals are disposed at the end of a first terminal array in which the plurality of first terminals are arrayed;

plating the contact terminal and the plurality of lands, by using as electrodes the first terminals and the second terminals;

cutting the contact board such that the cut edge of the second terminals is positioned at the one edge of the contact board; and applying insulating resin to cover the edge faces of the second terminals positioned on the one edge of the cut contact board.

7. The method of manufacturing a liquid ejecting head according to claim 6, wherein forming the first terminals and the second terminals involves forming the first terminals and the second terminals with the first wiring and the second wiring.

8. The method of manufacturing a liquid ejecting head according to claim 6, wherein a plurality of contact terminals, first terminals, and first wirings are respectively formed on the contact board, the plurality of first terminals and the second terminals are disposed to form a terminal array along the one edge of the contact board, and the second terminals are disposed at the ends of the terminal array.

9. The method of manufacturing a liquid ejecting head according to claim 6, wherein a third wiring is formed on the contact board, the third wiring has one end disposed on another edge other than the one edge of the contact board, and the other end connected to one of the plurality of lands.

10. The method of manufacturing a liquid ejecting head according to claim 6, wherein a part of the wiring member constitutes the contact board.

11. The liquid ejecting head according to claim 1, wherein the plurality of second terminals is not electrically connected to the printing element board.

* * * * *